US005338260A

United States Patent [19]

Smith

[11] Patent Number: 5,338,260

[45] Date of Patent: Aug. 16, 1994

[54] CHILDREN'S SWING

[75] Inventor: Stephen W. Smith, Bedford, Pa.

[73] Assignee: Hedstrom Corporation, Bedford, Pa.

[21] Appl. No.: 994,276

[22] Filed: Dec. 21, 1992

[51] Int. Cl.[5] ..... A63G 9/00

[52] U.S. Cl. ..... 472/118; 297/452.1

[58] Field of Search ..... 472/118, 119, 120, 121, 472/122, 124; 297/452

[56] References Cited

U.S. PATENT DOCUMENTS

| | | | |
|---|---|---|---|
| 3,261,607 | 7/1966 | Horowitz et al. | 472/118 |
| 3,712,614 | 1/1973 | Sherman et al. | 472/118 |
| 4,066,258 | 1/1978 | Yates | 472/118 |
| 4,793,607 | 12/1988 | Suellentrop | 472/118 |
| 5,197,925 | 3/1993 | Cunard | 472/118 |
| 5,216,780 | 6/1993 | Lutzke et al. | 472/118 X |

*Primary Examiner*—Carl D. Friedman

*Assistant Examiner*—Wynn Wood

*Attorney, Agent, or Firm*—Cesari and McKenna

[57] ABSTRACT

A children's swing includes a rigid, upwardly curved seat which has a planar seating portion and side portions which extend generally perpendicular to the seating portion and define the opposite ends of the seat. A longitudinal channel is present in the underside of the seating portion and passages extend from the opposite ends of the channel to the opposite ends of the seat. A long chain of links extends into the passage at one end of the seat, along the channel and out the passage at the other end of the seat. Interferences are provided in the seat which interfere with the chain links to fix the position of the seat along the chain so that when the opposite ends of the chain are suspended from an overhead support, the seating portion of the seat remains horizontal when the swing is at rest.

6 Claims, 1 Drawing Sheet

CHILDREN'S SWING

FIELD OF THE INVENTION

This invention relates to a children's swing. It relates more particularly to an improved seat for a children's swing set, play gym or the like.

BACKGROUND OF THE INVENTION

Most swings have seats which consist of a rigid platform. The platform may be a short wood plank or may be a molded plastic article. There are some swings with flexible swing seats consisting of rubber or plastic straps. These have an advantage over their rigid counterparts in that if a moving seat happens to strike a child, it will not cause serious injury.

Both the rigid and flexible seats are invariably suspended by a pair of chains or ropes from an overhead support such as the crossbar of a swing set. The lower ends of these chains are usually connected to the seat by way of eye bolts or rigid wire hangers at the opposite ends of the seat. These separate pieces of hardware must be stocked by the manufacture and either installed by the manufacturer or the customer. Therefore, they increase the overall cost of the swing and the difficulty of swing assembly. It would be desirable, therefore, to be able to eliminate these parts without adversely effecting the strength and reliability of the swing.

SUMMARY OF THE INVENTION

Accordingly, it is an object of the present invention to provide an improved swing for children.

Another object of the invention is to provide a swing having a minimum number of separate parts.

A further object of the invention is to provide a swing seat which is strong and safe to use, yet comfortable to sit on.

A further object of the invention is to provide the swing whose seat remains perpendicular to the chains or other suspension means supporting the seat.

Other objects will, in part, be obvious and will, in part, appear hereinafter.

The invention accordingly comprises the features of construction, combination of elements and arrangement of parts which will be exemplified in the construction hereinafter set forth, and the scope of the invention will be indicated in the claims.

The present swing includes a rigid seat which is contoured to comfortably support the occupant of the seat. The seat is supported by a single chain which extends along a channel formed in the underside of the seat. The opposite ends of the chain extend out of that channel through openings at the opposite ends of the seat and may be connected to an overhead support to suspend the seat above the ground. As will be described in more detail later, means are provided in the channel and in the opposite ends of the seat which co-act with the links of the chain to prevent the chain from sliding relative to the seat. Consequently, once the seat is properly positioned along the chain, it will remain in that same set position so that when hung, the seat will remain perpendicular to the lengths of chain supporting the opposite ends of the seat.

The swing seat itself is a more or less hollow molded plastic part which is strong and lightweight yet easy to manufacture in quantity. Therefore, it should provide long years of injury free service.

BRIEF DESCRIPTION OF THE DRAWING

For a fuller understanding of the nature and objects of the invention, reference should be had to the following detailed description, taken in connection with the accompanying drawing, in which.

DETAILED DESCRIPTION OF ILLUSTRATIVE EMBODIMENT

Figure 1:
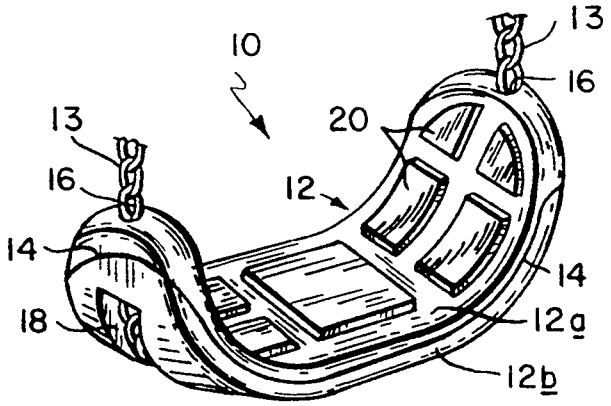
FIG. 1 is a fragmentary isometric view of a swing incorporating the invention.

Referring to FIG. 1 of the drawing, the subject swing, shown generally at 10, comprises a contoured seat 12 suspended by a single length of chain 13 from an overhead support such as the crossbar of a swing set or play gym (not shown). Seat 12 is a molded plastic part composed of an upper section 12*a* and a lower section 12*b* whose edges are welded together along a seam line 14 which extends more or less around the periphery of the seat. The chain 13 extends through an opening 16 at one end of the seat, along two longitudinal channels 18 formed in the underside of the seat and through an opening 16 at the opposite end of the seat. Thus, there are no direct links or mechanical connections between the chain 13 and the seat 12.

Preferably, raised bosses 20 are formed on the upper surface of seat section 12*a* to provide a non-slip surface and also to decorate the seat.

Figure 3:
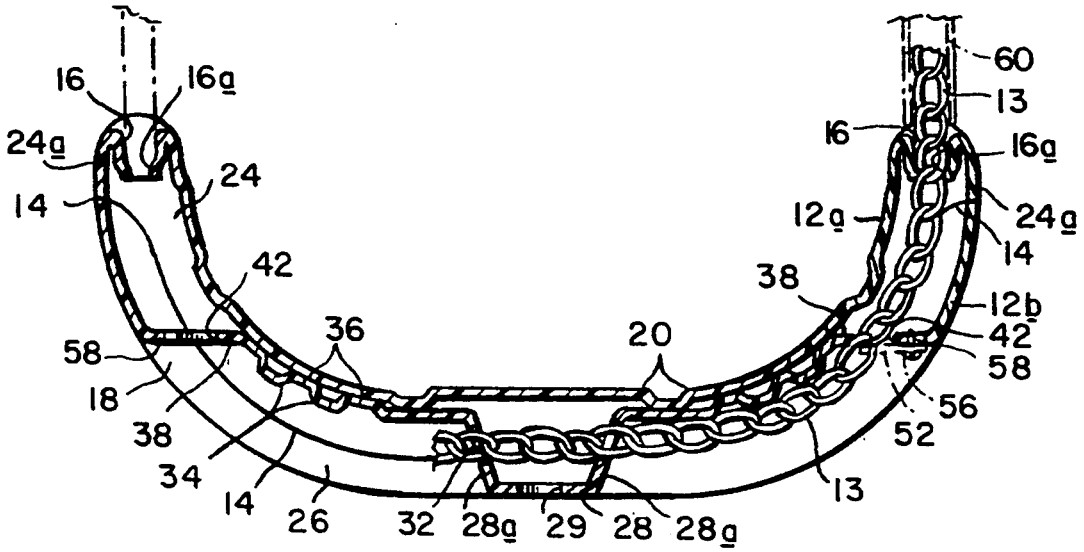
FIG. 3 is a sectional view taken along line 3—3 of FIG. 2.

As best seen in FIGS. 1 and 3, preferably the seat sections 12*a* and 12*b* are shaped so that when the seat is suspended by chain 13, the midportion of the seat is perpendicular to chain 13 while the end portions thereof are parallel to the chain. In other words, the seat is contoured so that it wraps around the underside of a child sitting in the seat making the seat very comfortable and safe to sit on.

As best seen in FIG. 3, the seat section 12*a* consists of an upwardly curved shell having a depending skirt 24 which extends all around the perimeter of section 12*a*. However, the skirt segments 24*a* at the opposite ends of the seat section 12*a* are longer than the remainder of the skirt 24 so that the weld seam 14 connecting sections 12*a* and 12*b* is located well below the ends of the seat so that the chain openings 16 are located entirely in the seat section 12*a*. Furthermore, an inwardly extending lip or flange 16*a* is formed around each opening 16 which helps to strengthen the ends of the seat section 12*a* where the chain 13 exits the seat and for other reasons to be described later.

The lower seat section 12*b* is an upwardly curved shell-like part with an upwardly extending peripheral wall 26 which mates edge-to-edge with skirt 24 of section 12*a* along the seam line 14.

The aforesaid channels 18 are formed at the longitudinal centerline of seat section 12*b*. The adjacent ends of the two channels are separated by a transverse channel-like bridging portion 28 whose side walls 28*a* form the opposing end walls of the channels 18. Openings 32 in those walls 28*a* provide tight clearances for the chain 13 to extend from one channel to the other. Also, a drain opening 29 is present in portion 28.

The floors of channels 18 on each side of bridging portion 28 are formed with goffers or crimps 34 which are connected by spot welds 36 or other suitable means to the upper seat section 12*a*.

The opposite end walls 38 of channels 18 are formed in seat section 12*b* between the goffers 34 and the ends of the seat. Openings 42 are provided in those walls to provide tight clearances for the chain 13. Chain 13 is installed in seat 12 by inserting an end of the chain through the opening 16 at one end of the seat and threading it down through opening 42 in the adjacent channel wall 38. The chain is then pulled along that channel and threaded through the openings 32 in the bridging portion 28 and pulled along the other channel 18. Then, the end of the chain is threaded through the hole 42 at the end of the other channel 18 and pulled out through the opening 16 at the other end of the seat.

The seat 12 is centered on the chain 13 by pulling the chain one way or the other through the seat. In this connection, is important to note that there is an interference fit between the flanges 16*a* at the seat end openings 16 and the links of chain 13. Additional interferences occur between the chain links and the seat at the edges of openings 42 and 32 formed in the lower seat section 12*b*. In addition, the links of the chain interfit with the goffers 34 in the floors of the two channels 18. Therefore, it takes a fair amount of force to move or to slide the chain 13 through the swing seat 12. Consequently, once the seat is positioned on the chain so that it is horizontal when suspended from the overhead support, there is little likelihood of the seat shifting away from that position.

Figure 2:
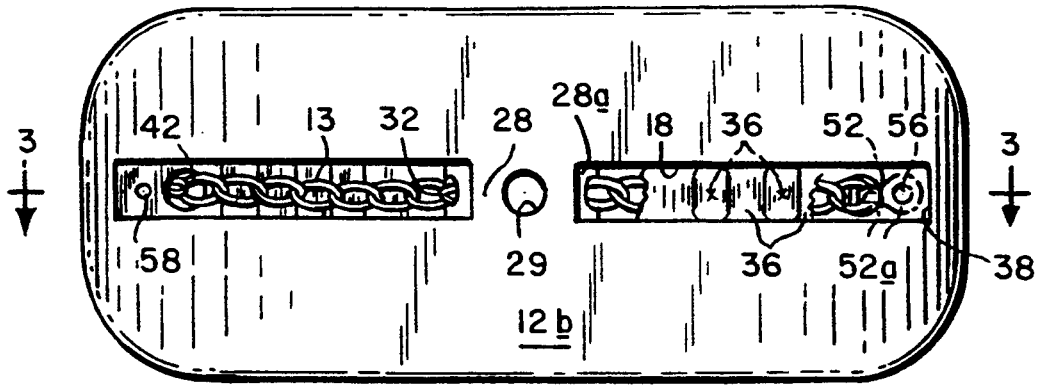
FIG. 2 is a bottom plan view on a larger scale and with parts broken away of the FIG. 1 swing.

Such movement of the seat relative to the chain may be made even more difficult by providing one or more tabs on the seat, each of which projects through a link of the chain. A tab such as this is shown in phantom at 52 in FIGS. 2 and 3 mounted to the right hand channel wall 38 in the lower seat section 12*b*. The tab has an enlargement 52*a* that receives a threaded fastener 56 which is turned down into a hole 58 in the wall 38. The tab projects through the eye of an adjacent chain link and prevents that link from shifting relative to the wall. Such a tab may be provided at one or both of the walls 38.

In some cases, it may also be desirable to cover chain 13 with a plastic sheath so that the chain will be easier and more comfortable for the child to grasp while swinging on the swing. A sheath such as this is indicated in phantom at 60 at the right side of FIG. 3. The sheath may cover only the exposed segments of chain 13 above seat 12 or the sheath may extend all along the chain, in which case the position retaining tabs 52 would not be used. Generally, the sheath conforms to the links of the chain so that the various interferences between the chain links and flanges 16*a*, goffers 34 and the edges of holes 32 and 42 will still exist.

It will thus be seen that the objects set forth above, among those made apparent from the preceding description are efficiently attained and, since certain changes may be made in the above construction without departing from the scope of the invention, it is intended that all matter contained in the above description are shown in the accompanying drawing shall be interpreted as illustrative and not in a limiting sense.

It is also to be understood that the following claims are intended to cover all of the generic and specific features of the invention described herein.

I claim:

1. A swing comprising a rigid hollow upwardly curved seat, having opposed mating upper and lower shells with peripheral skirts, seam means connecting opposing edges of the skirts, and a planar seating portion and side portions at the opposite ends of the seating portion which extend generally perpendicular to the plane of the seating portion and define the opposite ends of the seat, means defining a longitudinal channel in the underside of the seating portion, said channel defining means including a channel floor in the lower shell and means for securing the top of said channel floor to the upper shell;

means defining passages extending from the opposite ends of the channel through the side portions of the seat to the opposite ends of the seat;

a relatively long chain of links extending into the passage at one end of the seat, along said channel and out the passage at the other end of the seat, and means for fixing the position of the seat along the chain so that when the opposite ends of the chain are suspended from an overhead support, the seating portion of said seat is generally horizontal when the swing is at rest, said fixing means including generally laterally extending goffers formed in said channel floor which interfere with the chain links in said channel, at least some of said goffers being secured to said upper shell.

2. The swing defined in claim 1 wherein the openings into said passages at the opposite ends of the seat are located entirely in the upper shell.

3. The swing defined in claim 1 wherein the fixing means include walls of said passages which interfere with the chain links in said passages.

4. The swing defined in claim 1 wherein the fixing means include at least one relatively rigid tab extending through a link of said chain in said channel, and means for anchoring said at least one tab to said lower shell.

5. The seat defined in claim 1 and further including a conforming plastic sheath covering said chain.

6. A swing comprising a rigid, hollow, upwardly curved, molded plastic seat composed of opposed mating upper and lower shells with peripheral skirts, and seam means connecting opposed edges of said skirts, and having a planar seating portion and side portions at the opposite ends of the seating portion which extend generally perpendicular to the plane of the seating portion and define the opposite ends of the seat, means defining a longitudinal channel in the underside of the seating portion, and means defining passages extending from the opposite ends of the channel through the side portions of the seat to the opposite ends of the seat;

a relatively long chain of links extending into the passage at one end of the seat, along said channel and out the passage at the other end of the seat, said lower shell having a bridging portion which divides said channel longitudinally into two sections and means defining a third passage through said bridging portion for receiving said chain, and means for fixing the position of the seat along the chain so that when the opposite ends of the chains are suspended from an overhead support, the seating portion of said seat is generally horizontal when the swing is at rest, said fixing means including walls of said third passage which interfere with the chain links in said third passage.

* * * * *